United States Patent [19]

Ruehl

[11] Patent Number: 4,553,802

[45] Date of Patent: Nov. 19, 1985

[54] MODULAR BRIDGING CLIP

[75] Inventor: William E. Ruehl, Wheeling, Ill.

[73] Assignee: Illinois Tool Works Inc., Chicago, Ill.

[21] Appl. No.: 513,793

[22] Filed: Jul. 14, 1983

Related U.S. Application Data

[63] Continuation of Ser. No. 289,022, Aug. 3, 1981, abandoned.

[51] Int. Cl.[4] ..... H01R 13/62

[52] U.S. Cl. ..... 339/74 R; 339/176 MP

[58] Field of Search ..... 339/19, 74 R, 222, 176 MP

[56] References Cited

U.S. PATENT DOCUMENTS

| | | | |
|---|---|---|---|
| 3,569,903 | 3/1971 | Brishka | 339/74 R |
| 3,710,303 | 1/1973 | Gallager, Jr. | 339/74 R |
| 3,990,761 | 11/1976 | Jayne | 339/74 R |
| 4,029,376 | 6/1977 | Headington et al. | 339/222 X |
| 4,077,688 | 3/1978 | Cobaugh | 339/74 R |
| 4,148,537 | 4/1979 | Sochor | 339/74 R |
| 4,350,402 | 9/1982 | Douty et al. | 339/74 R |

*Primary Examiner*—Gil Weidenfeld
*Assistant Examiner*—Paula A. Austin
*Attorney, Agent, or Firm*—J. P. O'Brien; T. W. Buckman; J. R. Halvorsen

[57] ABSTRACT

A modular bridging clip adapted for use with telecommunications terminal blocks including a non-conductive compartmented housing for retaining a plurality of resilient conductive bridging clips whereby said clips can be readily applied or removed simultaneously from a like number of rows of terminal contacts. Each compartment includes slot means for accepting at least a pair of adjacent in line terminal contacts within the bridging clip contained therein and also includes means for easing the removal of said clip from the contact.

12 Claims, 7 Drawing Figures

MODULAR BRIDGING CLIP

This application is a continuation of application Ser. No. 289,022, now abandoned, filed 8/3/81.

BACKGROUND OF THE INVENTION

In the field of telephonic communications large terminal blocks are utilized as a means of interconnecting incoming lines to switch gear as well as for purposes of distribution of lines to individual telephones within a localized environment. Such terminal blocks normally include a plastic base having a plurality of upstanding side marginal posts for segregating wires which will be interconnected to one or more flat split terminal contacts wherein the wire is slid between adjacent flexible legs of the contact, as is well known in the art. It has become common practice, for purposes of saving the labor time of wiring adjacent terminal contacts, to use a bridging clip, generally of a metallic conductive nature, which is applied to adjacent in line terminal contacts. Such a device is shown in U.S. Pat. No. D 224,406, such a device includes a pair of resilient legs generally U-shaped in nature and interconnected by a bight portion. This device includes an elongated slot in one leg so that the two portions defined by said slot will operate independently of one another so as to accomodate thickness tolerances in adjacent flat terminal contact members.

In many instances it has been found desirable to interconnect a plurality of telephones for common functions. While the bridging clip shown in U.S. Pat. No. D 224,406 is ideally suited for a single bridging function it has been found that it is time consuming to remove these from a terminal block when a revamping or modification to an installation is required.

SUMMARY OF INVENTION

The present invention relates to a modular bridging clip including a non-conductive housing that is compartmented to retain a plurality of two or more bridging clips that can be applied simultaneously to spaced rows of terminal contacts. A further object of the present invention is to provide an economical device, which can be readily fabricated and assembled, and which will expedite installation and/or removal of a plurality of bridging clips.

Another object of the present invention is to provide a device whose compartments are so spaced as to be compatible with the conventional row spacing found in commercial terminal blocks.

Still another object of the present invention is to provide means which will facilitate easy removal of the plurality of bridging clips without damage to the terminal contacts, even after repeated usage. To accomplish this latter end, the present invention includes means for opening-up the throat defined by the resilient legs of the bridging clips so that removal from a terminal contact is more readily attainable.

Other objects will be apparent to those skilled in the art when the attached claims are read in conjunction with the following drawing.

DETAILED DESCRIPTION

Figure 1:
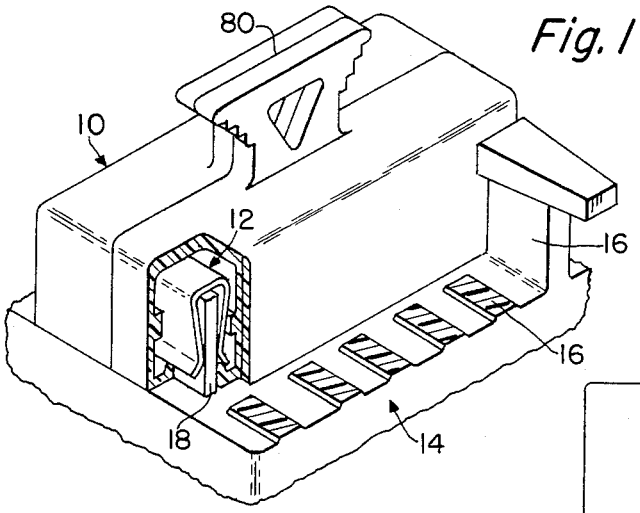
FIG. 1 is a perspective view in partial section of an embodiment of the present invention shown in mounted position on a terminal block.
Figure 2:
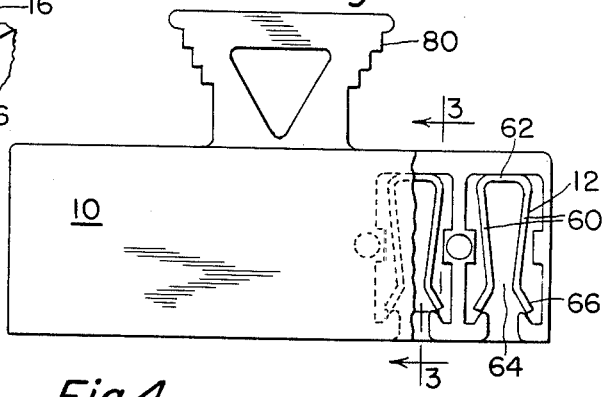
FIG. 2 is an elevational view partially cut away to show the disposition of at least two bridging clips within the housing.

Referring now to the drawing wherein similar parts are designated by similar numerals, a modular bridging clip of the type contemplated by the present invention includes a compartmented housing 10 carrying a plurality of two or more bridging clips 12 adapted to be utilized with a terminal block 14 having the normal side post wiring separators 16 and a plurality of rows of contact terminals 18. In this view the wiring posts 16 have been removed and no wires are shown positioned between adjacent wiring posts, for purposes of clarity.

Figure 4:
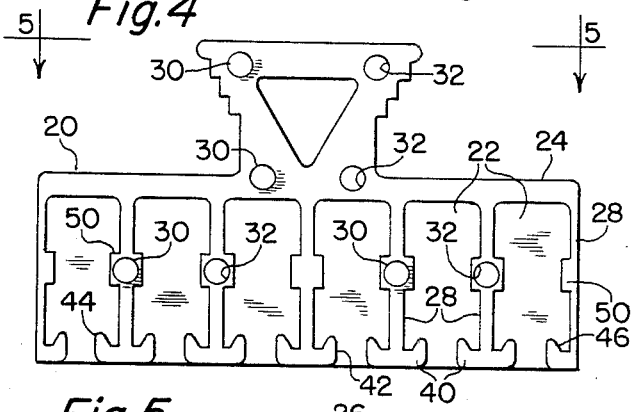
FIG. 4 is an elevational view of one half of the housing as taken along line 4—4 and is shown before assembly and without the briding clips assembled thereto.
Figure 5:
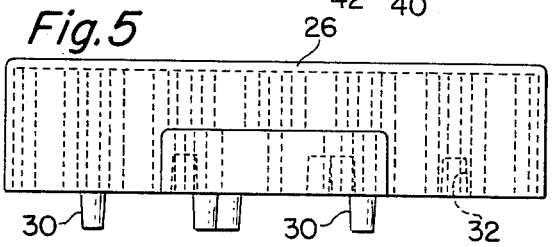
FIG. 5 is a top view taken along line 5—5 of FIG. 4 of one half of the housing.

The housing 10, in this embodiment, is comprised of two identical portions 20, as best seen in FIGS. 4 and 5, and includes a plurality of compartments 22 that are defined by a top wall 24, a back wall 26 and a plurality of dividing or end walls 28, which in the present embodiment illustrated defines six compartments 22. A plurality of posts 30 extend laterally from the body 20 and are adapted to be accepted within an equal number of hollow bores 32 whereby identically molded halves will match with the posts 30 being acceptable into the bores 32. Thus, economies in manufacture are present and provide ease in assembly.

The chambers 22 are further defined by a pair of inwardly directed opposed flanges 40 that define a transverse slot 42 serving as a throat to accept the terminal contacts 18 into the compartments 22. Flanges 40 include an upwardly turned portion 44 having an inner outwardly extending cam surface 46 for purposes set forth hereinafter. Intermediate the extremities of the side walls 28 there is provided reinforcing ribs 40 which serve to strengthen the structure as well as providing means for supporting the posts 30 and the bores 32 to facilitate assembly.

Figure 3:
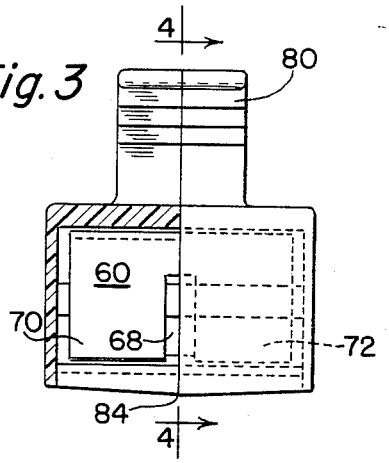
FIG. 3 is an end view taken along line 3—3 of FIG. 2.

The bridging clips 12 are assembled within the housing 10 by providing one bridging clip into each compartment 22. As will be appreciated these can be either manually or automatically assembled into one half of the housing 10 and an identical half superimposed thereon. It will be noted that the bridging clip 12 which includes a pair of legs 60 interconnected by a bight portion 62 generally taper inwardly toward one another from the bight portion 62 to form a throat 64 from which point the legs flare outwardly as at 66. Additionally it is noted that at least one leg 60 is slotted, as best seen in FIG. 3, by the slot 68 that extends into one leg a substantial distance thereby defining two independent leg portions 70 and 72 which will accept adjacent in line terminal contacts 18 that may have variations in tolerances in thickness but which the clip 12 will tolerate by the independent legs 70 and 72.

To further facilitate usage of such a device a handle 80 is provided on the upper side to permit manual manipulation by a repairman.

Figure 6:
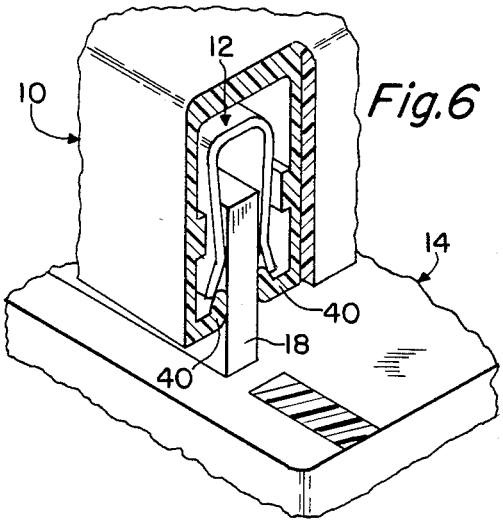
FIG. 6 is a perspective view in partial section similar to the view in FIG. 1 but illustrating a device during removal.
Figure 7:
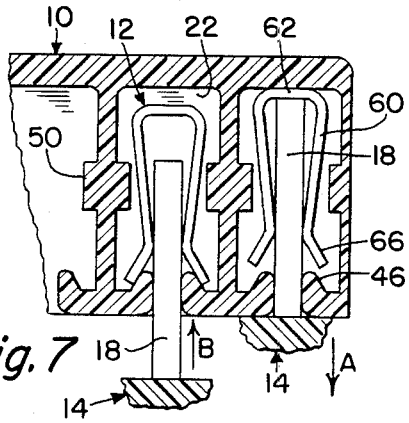
FIG. 7 is a sectional view of a portion of a housing, including the bridging clips, and showing the positionment of the bridging clips during insertion and removal.

Referring now to FIGS. 6 and 7, it will be noted that in the right hand compartment of FIG. 7 the housing 10 has been moved in the direction indicated by the arrrow "A" whereby the contact 18 traverses the throat 42 and enters the throat 64 of the bridging clip and pushes the bight 62 against the top wall 24 of the housing. This insures a tight gripping of the legs 60 against adjacent in line pairs of contacts 18. As the housing 10 is moved upwardly, as shown by the arrow "B" in FIG. 7, the bridging clip 12 is moved downwardly within compartment 22 so that the flared portion 66 of the bridging clip 12 engages the inner cam surfaces 46 and spreads the legs 60 laterally to open the throat 64 so that the contact 18 can be readily removed. In FIG. 6 it will be noted that the bridging clip 12 is pulled all the way down against the flange 40 and is flared open into almost parallel straight legged position. Such an arrangement provides for ready insertion and removal of the modular device and the camming of the legs outwardly tends to relieve any seizing between the conductive bridging clip and the terminal contact. As can be best seen in FIG. 3, the bottom of the end walls are tapered from the outside toward the center to provide a rocking point 84 so that the handle may be moved from side to side to assist in the elimination of any seizing problems.

Thus, applicant has disclosed a device which can be fabricated by injection molding the housing 10 from suitable plastic materials such as polypropylene or any other suitable material, made in identical halves which are joined first by locating posts 30 within bores 32 and then sonically welded, heat sealed or adhesively sealed to provide an enclosed housing having spaced compartments adapted to accept a conductive bridging clip for application simultaneously of a plurality of such bridging clips. The bridging clips are preferrably fabricated from a resilient metallic material that has spring tempered characteristics such as phosphor bronze which can, if desired, be solder plated after stamping to assist in prevention of corrosion. Other suitable spring materials will be apparent to those skilled in the art. Modifications to the single embodiment disclosed herein can be made without departing from the spirit and scope of the attached claims.

I claim:

1. A modular bridging device for use with a telecommunications terminal block having plural rows of contact terminals, said device including non-conductive housing means having at least one compartment therein and a discrete generally U-shaped electrically conductive bridging clip installed in each said at least one compartment, each said bridging clip including a bight portion and pair of resilient legs defining a throat adapted to receive a contact terminal, each said at least one compartment having interior wall means for loosely retaining in an inverted manner the bridging clip installed therein and for permitting said bridging clip to slide in a generally parallel direction to said pair of legs, each said at least one compartment including slot means in communication with said interior wall means and in general alignment with and providing access to said throat of the bridging clip retained therein, and cam means carried by said interior wall means adjacent to said slot means in each said at least one compartment for engaging and spreading the legs of the bridging clip retained therein in direct response to said housing being moved away from said terminal block in a generally parallel direction to said pair of legs of each of said bridging clips thereby facilitating removal of said device from said terminal block.

2. A device of the type claimed in claim 1 wherein said housing means is an injection molded plastic part.

3. A device of the type claimed in claim 1 wherein said housing means is two mating pieces that assemble together to form said at least one compartment and including means for retaining one clip in each compartment.

4. A device of the type claimed in claim 1 wherein said housing means includes manual gripping means for manipulation purposes.

5. A device of the type claimed in claim 1 wherein said U-shaped clips are resilient and made from an anticorrosive metallic material.

6. A device of the type claimed in claim 5 wherein said clips are formed of spring tempered phosphor bronze and solder plated.

7. A device of the type claimed in claim 1 wherein said housing means includes a plurality of discrete isolated compartments, each of said plurality of compartments having slot means to provide access thereto, each of said interior wall means having a length greater than the length of said pair of legs for permitting sliding movement, said cam means being defined by a pair of opposed inwardly extending flange means, the width of each said slot means being less than the width of the opening formed by the free ends of the legs of said U-shaped clip to thereby retain said clip in said compartment.

8. A device of the type claimed in claim 7 wherein the free ends of the legs of each of said U-shaped clips are flared outwardly away from one another to form an open throat for accepting said contact terminals and are spaced apart a greater distance than the distance between the inner extent of said pair of flange means.

9. A device of the type claimed in claim 8 wherein said at least one compartment having a transverse dimension larger than said flared free ends of the legs of said U-shaped clip to permit expansion of said legs upon introduction of said contact terminal.

10. A device of the type claimed in claim 8 wherein said cam means for the spreading of said legs includes at least one cam surface disposed on said pair of inwardly extending flange means which partially blocking access to said compartment and defining said slot means, said cam means disposed to engage said flared ends of said legs to cause said throat to open up and permit ready withdrawal from said contact terminal.

11. A modular bridging device for use with a telecommunication terminal block having plural rows of contact terminals, said device including a non-conductive housing having a plurality of discrete isolated compartments, each of said plurality of compartments being enclosed except for an elongate slot formed through its bottom surface to provide access thereto, a discrete generally U-shaped electrically conductive bridging clip installed in each of said compartments, each of said bridging clip including a bight portion and a pair of resilient leg portions which define a throat for receiving one of said contact terminals, each of said compartments having interior wall means for loosely retaining its respective bridging clip in an inverted manner with said throat in general alignment with said elongate slots, the width of said elongate slot being less than the distance between the free ends of said leg portions, the distance of each of said compartments generally perpendicular to its bottom surface being greater than the length of said bridging clip's pair of legs to permit sliding movement therein in a direction generally perpendicular to said pair of legs, and cam means carried by said interior wall means adjacent to said elongate slot in each of said compartments for engaging and spreading the pair of leg portion of the bridging clip retained therein in direct response to said housing being moved away from said terminal block in a generally perpendicular direction to said bottom surface of said compartments to thereby facilitate removal of said device from said terminal block.

12. A device of the type claimed in claim 11, wherein said cam means in each of said compartments comprises a pair of opposed inwardly extending flanges disposed along said elongate slot, each flange having a cam surface that extends away from said bottom surface and towards said throat defined by the space between said pair of resilient leg portions, and wherein the free ends of said pair of leg portions are flared outwardly away from one another, the distance between the outermost point of said flared ends being greater than the distance between the innermost point of said cam surfaces such that said pair of leg portions will engage said pair of cam surfaces upon said device being removed from said terminal block and cause said leg portions to spread apart to thereby facilitate the removal of said device from said terminal block.

* * * * *